US007058318B2

(12) United States Patent
Nakahara

(10) Patent No.: US 7,058,318 B2
(45) Date of Patent: Jun. 6, 2006

(54) IMAGE FORMING APPARATUS

(75) Inventor: Yasutomo Nakahara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/941,885

(22) Filed: Sep. 16, 2004

(65) Prior Publication Data

US 2005/0058463 A1 Mar. 17, 2005

(30) Foreign Application Priority Data

Sep. 17, 2003 (JP) ..... 2003-324860

(51) Int. Cl.
*G03G 15/00* (2006.01)
*B41J 11/46* (2006.01)

(52) U.S. Cl. ..... 399/16; 399/18; 399/21; 400/76

(58) Field of Classification Search ..... 399/16, 399/18, 21; 400/76
See application file for complete search history.

(56) References Cited

U.S. PATENT DOCUMENTS 6,021,284 A * 2/2000 Serizawa et al. ..... 399/8
6,240,261 B1 * 5/2001 Tomidokoro ..... 399/8
6,407,826 B1 * 6/2002 Hashimoto et al. ..... 358/296
6,511,239 B1 * 1/2003 Kretschmann et al. ..... 400/579
6,535,698 B1 * 3/2003 Horikoshi ..... 399/16
2002/0136564 A1 * 9/2002 Takamine et al. ..... 399/82

FOREIGN PATENT DOCUMENTS

JP 2002-283676 A 10/2002

* cited by examiner

*Primary Examiner*—Andrew H. Hirshfeld
*Assistant Examiner*—Marvin P. Crenshaw
(74) *Attorney, Agent, or Firm*—Birch, Stewart, Kolasch & Birch, LLP

(57) ABSTRACT

An image forming apparatus includes a sheet ejection sensor 4 disposed immediately downstream of a fixing device 3 that detects the passage of a sheet P, time measurement means 61 that measure a time T4 from when a print start signal is transmitted during an margin adjustment to when the sheet is detected by the sheet ejection sensor, time storage means 62 that store a proper setting time T5 that is considered as an appropriate time from when the print start signal is transmitted to when the sheet is detected by the sheet ejection sensor so as to set predetermined end margins, and control means 63 that automatically corrects an signal transmission timing of the print start signal so as to achieve a match between the measured time measured by the time measurement means and the proper setting time stored by the time storage means.

5 Claims, 3 Drawing Sheets

IMAGE FORMING APPARATUS

This application claims priority under 35 USC 119(a) to patent application Ser. No. 2003-324860 filed in Japan on 17 Sep. 2003, the content of which is incorporated herein by reference in its entirety.

BACKGROUND OF THE INVENTION

The present invention relates to an image forming apparatus capable of setting the proper end margins of a recording sheet.

Setting of the end margins on a recording sheet (for determining the position of the recording sheet where the image begins) has been carried out by an operator having print position check data printed in the inspection step of an image forming apparatus and visually checking the print position for the amounts of misalignment.

On the other hand, there is an image forming apparatus (see, e.g., Japanese Patent Application Laid-Open Publication No. 2002-283676) designed to automatically set the end margins by using a recording sheet marked at given positions and passing the sheet through the image forming apparatus during setting of the end margins of a recording sheet.

Thus, in conventional image forming apparatuses, end margin setting has been achieved through the operator setting or by use of a special recording sheet.

However, the end margins of a recording sheet vary depending upon factors such as the sheet transfer speed, the recording sheet qualities (e.g., elasticity, thickness), the conditions of the sheet feed unit (sheet feed in the main unit, secondary sheet feed), the sheet feed method and the individual difference in the image forming apparatus. Under such varying conditions, it has been extremely difficult to properly set the end margins of a recording sheet, thus resulting in the need to repeat the setting process a number of times until the end margins of the recording sheet are properly set. This has entailed a large amount of labor and time in the adjustment task in the inspection step, making the task extremely inefficient. On the other hand, the end edges of a recording sheet vary also with secular changes in the apparatus, necessitating the user to set the end margins by eliminating the effects of the print conditions and secular changes and using the margin adjustment and other functions in order to secure the proper end margins.

SUMMARY OF THE INVENTION

The present invention was conceived in light of the above, and it is therefore an object of the present invention to provide an image forming apparatus capable of automatically setting the proper end margins without resorting to a difficult operator setting or to a setting using a special recording sheet.

In order to achieve the above object, an aspect of the present invention provides an image forming apparatus comprising sheet detection means disposed at a predetermined position between an image forming unit and a sheet ejection unit that detects the passage of a recording sheet; time measurement means that measure a time from when a print start signal is transmitted during the end margin adjustment to when the recording sheet is detected by the sheet detection means; time storage means that stores a proper setting time that is considered as an appropriate time from when the print start signal is transmitted to when the recording sheet is detected by the sheet detection means so as to set predetermined end margins; and control means that automatically controls the signal transmission timing of the print start signal so as to achieve a match between the measured time measured by the time measurement means and the proper setting time stored by the time storage means.

This particular feature automatically controls the signal transmission timing of a print start signal so as to achieve a match between a measured time—a time, from when the print start signal is transmitted during the end margin adjustment to when a recording sheet is detected by sheet detection means at a given position between an image forming unit and a sheet ejection unit, measured by time measurement means—and a proper setting time—an appropriate time, from when the print start signal for setting the given end margins is transmitted to when the recording sheet is detected by the sheet detection means, stored by time storage means, thus eliminating the need for a difficult operator setting or a setting using a special recording sheet, automatically correcting the end margins of the recording sheet and allowing proper setting of the end margins thereof irrespective of the sheet transfer speed, the recording sheet qualities (e.g., elasticity, thickness), the conditions of the sheet feed unit (sheet feed in the main unit, secondary sheet feed), the sheet feed method and the individual difference in the image forming apparatus. Moreover, it is possible to secure the proper end margins even in the presence of secular changes in the apparatus.

DESCRIPTION OF THE PRESENT INVENTION

An embodiment of the present invention will be hereinafter described with reference to the drawings.

Figure 1:
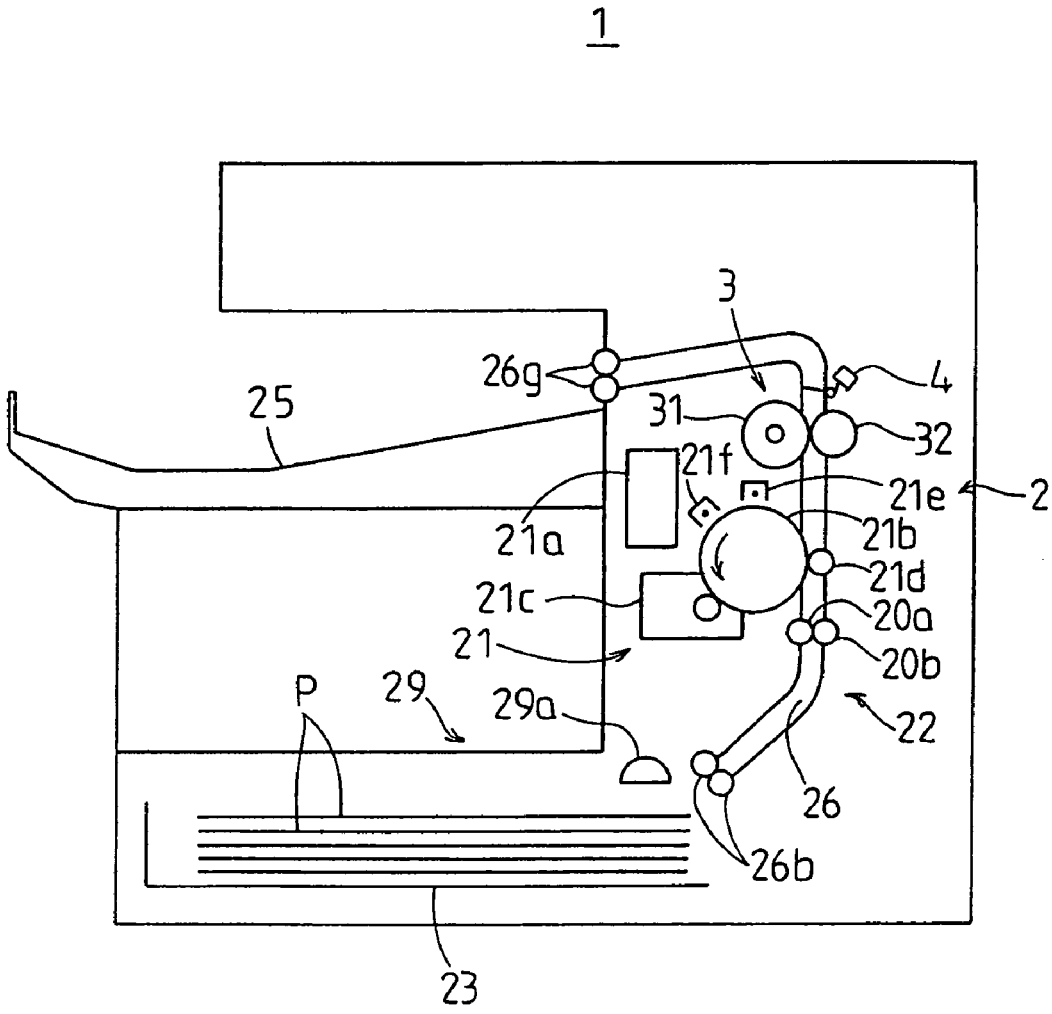
FIG. 1 is a schematic sectional view of a printer according to an embodiment of the present invention.

FIG. 1 shows the outline of the inner structure of a printer 1 according to the present embodiment. The printer 1 is provided with a print unit 2 as an image forming unit as shown in FIG. 1.

The print unit 2 is provided with an image forming mechanism 21 and a sheet transfer mechanism 22.

The image forming mechanism 21 is provided with a laser scanning unit 21*a* and a drum type photoconductor drum 21*b*. The laser scanning unit 21*a* is designed to irradiate a laser beam, based on an image data, to the surface of the photoconductor drum 21*b*. The photoconductor drum 21*b* rotates in the direction shown by an arrow in FIG. 1, forming an electrostatic latent image on its surface as a result of irradiation of the laser beam from the laser scanning unit 21*a*.

On the outer perimeter of the photoconductor drum 21*b*, on the other hand, a developing device 21*c*, a transfer roller 21*d*, a cleaning device not shown, a charge eliminator 21*e* and a main charger 21*f* are disposed along the circumferential direction in sequence. The developing device 21*c* develops the electrostatic latent image formed on the surface of the photoconductor drum 21*b* into a visible image using a toner. The transfer roller 21*d* transfers a toner image formed on the surface of the photoconductor drum 21*b* to a sheet P as a recording sheet. The cleaning device removes the toner remaining on the surface of the photoconductor drum 21*b* after the toner transfer. The charge eliminator 21*e* removes the residual charge from the surface of the photoconductor drum 21*b*. The main charger 21*f* charges, prior to formation of the electrostatic latent image, the surface of the photoconductor drum 21*b* at a given potential.

When an image is formed on the sheet P, the surface of the photoconductor drum 21*b* is charged at a given potential by the main charger 21*f*, causing the laser scanning unit 21*a* to irradiate a laser beam, based on the image data, to the surface of the photoconductor drum 21*b*. Then, the developing device 21*c* develops a visible image on the surface of the photoconductor drum 21*b* using the toner, with the toner image transferred to the sheet P by the transfer roller 21*d*. Further, the cleaning device removes the toner remaining on the surface of the photoconductor drum 21*b*, with the residual charge removed from the surface of the photoconductor drum 21*b* by the charge eliminator 21*e*. This completes one cycle of the image forming operation (print operation) to the sheet P. As this cycle is repeated, images can be formed continuously on the plurality of sheets P and so on.

On the other hand, the sheet transfer mechanism 22 causes the image forming mechanism 21 to form images by transferring the sheets P and so on, accommodated in a sheet feed cassette 23, one at a time and ejects the sheets P to a sheet ejection tray 25 as a sheet ejection unit.

The sheet transfer mechanism 22 is provided with a transfer route 26. The transfer route 26 is opposed to the ejection side of the sheet feed cassette 23 at one end and the sheet ejection tray 25 at the other end. In this case, the sheet feed cassette 23 is attached so as to be withdrawable to the front side of the printer 1.

A sheet feed device 29 is provided on the upstream end of the transfer route 26 opposed to the ejection side of the sheet feed cassette 23. The sheet feed device 29 is provided with a pickup roller 29*a* for sending out the sheets P one at a time from the sheet feed cassette 23. Sheet feed rollers 26*b* are disposed on the immediate downstream side of the pickup roller 29*a*. The sheets P, accommodated in the sheet feed cassette 23, are sent out one at a time and intermittently into the transfer route 26 as a result of rotation of the pickup roller 29*a* and the sheet feed rollers 26*b*.

On the other hand, PS rollers 20*a* and 20*b* are disposed upstream of where the transfer roller 21*d* is disposed. The PS rollers 20*a* and 20*b* are provided with the PS roller 20*a* of the driving side serving as a drive source and the PS roller 20*b* of the driven side that comes in contact with the PS roller 20*a* and rotates by being driven by the PS roller 20*a*. The PS rollers 20*a* and 20*b* are arranged on the immediately upstream side of (immediately before) the photoconductor drum 21*b*, feeding the sheets P between the photoconductor drum 21*b* and the transfer roller 21*d* while at the same time aligning the toner image on the surface of a photoconductor 31*b* with the sheets P. On the side downstream of where the transfer roller 21*d* is disposed in the transfer route 26, a fixing device 3 is provided that fixes the toner image to the sheets P by thermally melting and pressurizing the toner image. The fixing device 3 is provided with a heating roller 31 incorporating a heater (not shown) and a pressurizing roller 32 that comes in pressed contact with the heating roller 31 via the sheets P. Then, a sheet ejection sensor 4 is provided, as sheet detection means for detecting the passage of the sheets P, at a given position between the print unit 2 and the sheet ejection tray 25 in the transfer route 26, i.e., immediately downstream of the fixing device 3. On the other hand, signal transmission means 64 (shown in FIG. 2) are provided for transmitting a print start signal to the PS roller 20*a* of the driving side at a timing when it is possible to align the toner image on the surface of the photoconductor 31*b* with the sheets P.

Figure 2:
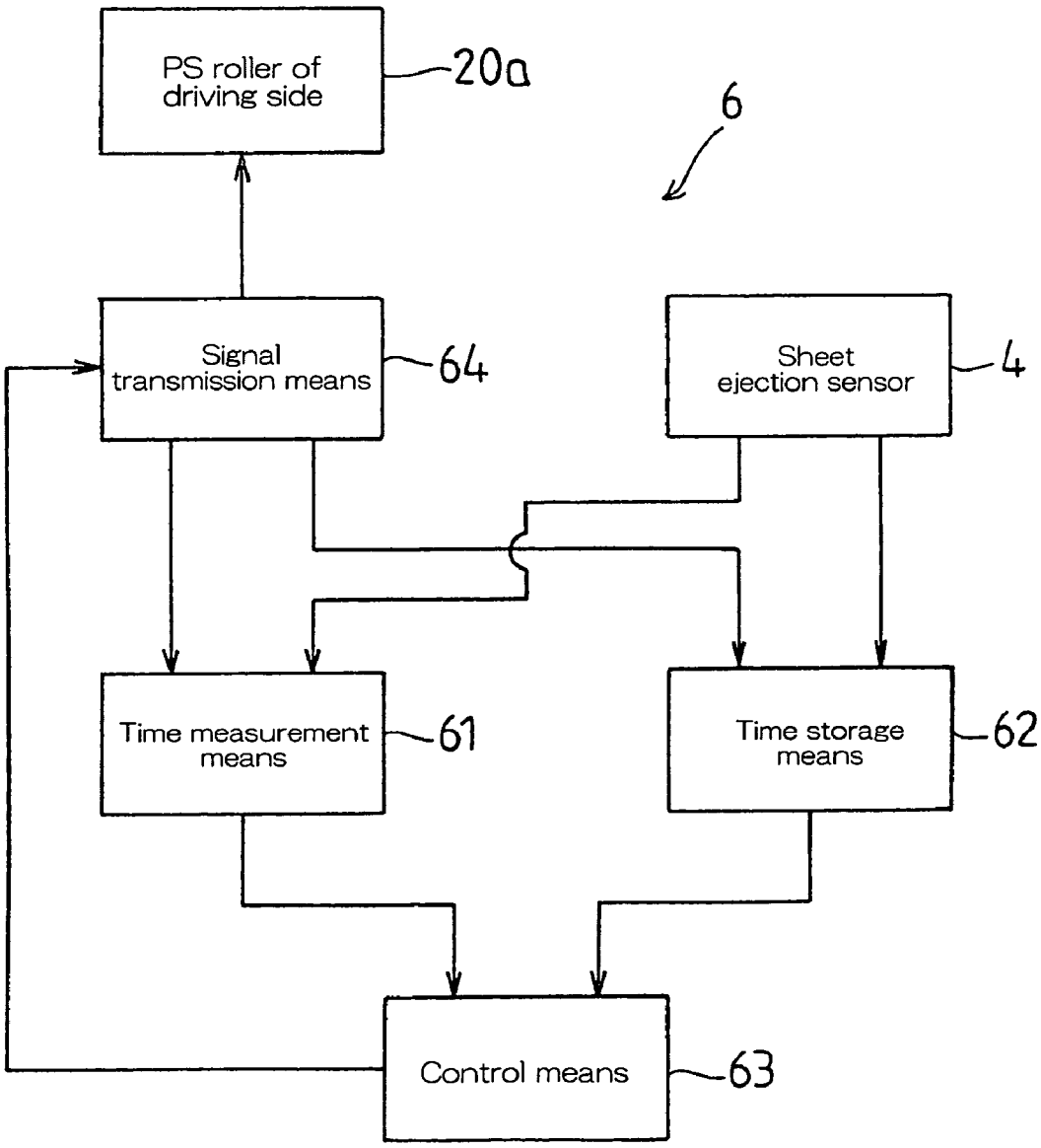
FIG. 2 is a block configuration diagram showing a configuration of an end margin adjustment device according to the embodiment of the present invention.

The printer 1 is provided with an end margin adjustment device 6 in the print unit 2 for properly setting the end margins of the sheets P as shown in FIG. 2. The end margin adjustment device 6 is provided with time measurement means 61 for measuring a time T4 (see FIG. 3) from when a print start signal is transmitted from the signal transmission means 64 to the PS roller 20*a* of the driving side during the end margin adjustment to when the sheet P is detected by the sheet detection sensor 4, time storage means 62 for storing in advance a proper setting time T5 (see FIG. 3), an appropriate time from when the print start signal is transmitted from the signal transmission means 64 to the PS roller 20*a* of the driving side to when the sheet P is detected by the sheet detection sensor 4, and control means 63 for automatically correcting (controlling) the signal transmission timing of the print start signal from the signal transmission means 64 to the PS roller 20*a* of the driving side so as to achieve a match between the measured time measured by the time measurement means 61 and the proper setting time stored by the time storage means 62.

Figure 3:
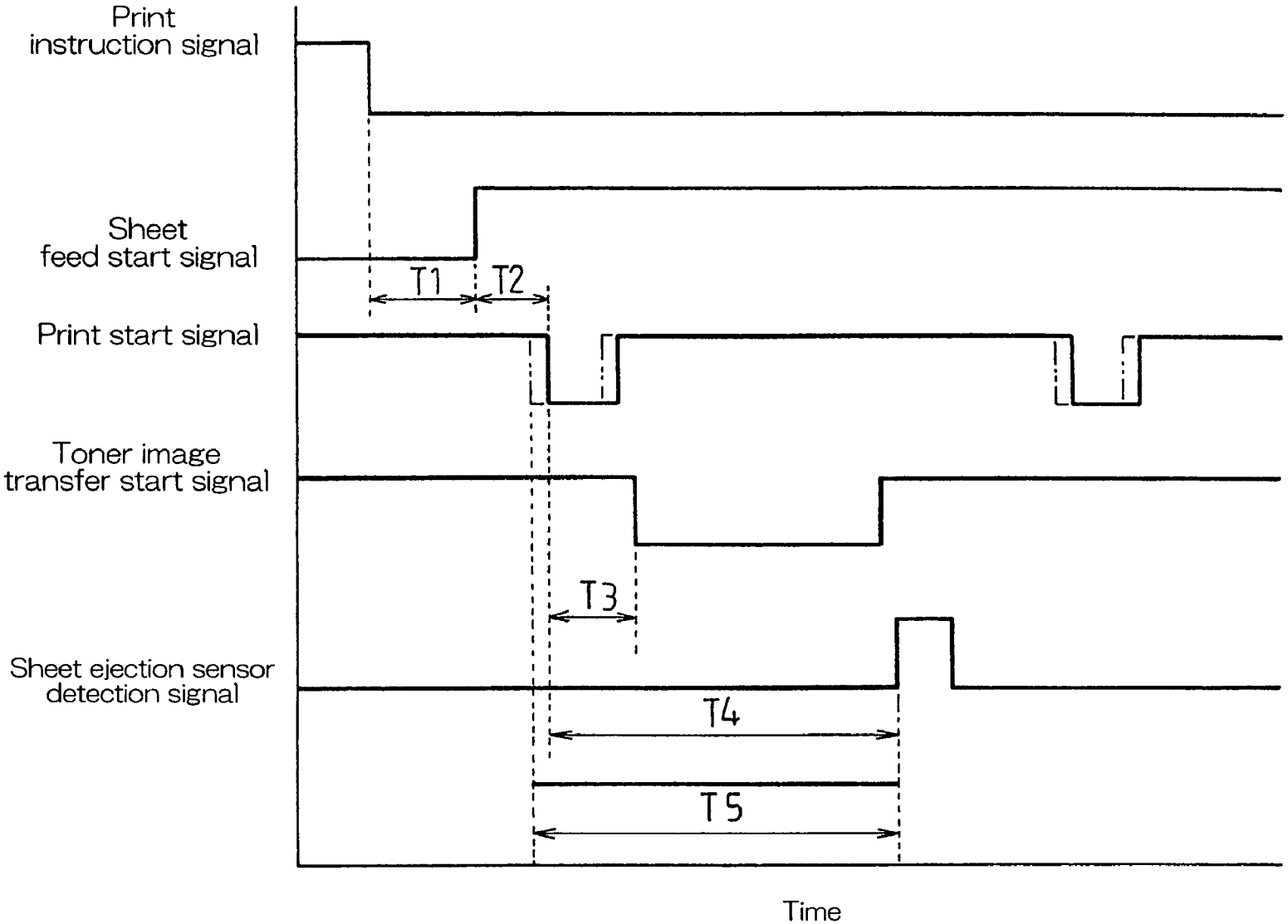
FIG. 3 is a timing chart during an adjustment of the end margins according to the embodiment of the present invention.

Following FIG. 3, the step of setting the end margins of the sheet P by the end margin adjustment device 6 together with the image forming step will next be described.

First, when image data is input from an external terminal not shown to the laser scanning unit 21*a*, a print instruction signal is transmitted nearly at the same time, starting the main drive motor (not shown) and rotating the drive gears that are not shown.

Then, when a time T1 seconds elapse from the moment of transmission of the print instruction signal, a sheet feed start signal is transmitted, rotating the pickup roller 29*a* and feeding the sheet P. The fed sheet P passes through the sheet feed rollers 26*b* and reaches the PS rollers 20*a* and 20*b* via the transfer route 26. Here, the sheet P stops temporarily to achieve synchronization with the image end portion on the photoconductor drum 21*b*, with the end portion of the sheet P pressed uniformly against the PS rollers 20*a* and 20*b* for correction of the end position of the sheet P.

On the other hand, the photoconductor drum 21*b* is first stripped of charge by the charge eliminator 21*e* and then charged entirely to a given charging potential by the main charger 21*f*. Then, a laser beam from the laser scanning unit 21*a* is irradiated to the photoconductor drum 21*b* through a polygon mirror (not shown) and various lenses (not shown), thus forming an electrostatic latent image on the photoconductor drum 21*b*. Thereafter, the toner on the MG roller (not shown) within the developing device 21*c* is attracted onto the surface of the photoconductor drum 21*b*, thus allowing the toner to make the electrostatic latent image visible correspondingly with the potential gap on the photoconductor drum 21*b*.

When a print start signal is transmitted from the signal transmission means 64 to the PS roller 20*a* of the driving side in a time T2 seconds after the sheet feed start signal is transmitted, the sheet P, on which an image will be formed, is transferred in the direction of the photoconductor drum 21*b* in a timed manner, and in a T3 seconds after the print start signal is transmitted from the signal transmission means 64, the toner image on the photoconductor drum 21*b* begins to be transferred to the sheet P by the transfer roller 21*d*. At this time, the toner remaining on the photoconductor drum 21*b* is scratched off and collected by a cleaning blade of the cleaning device. At this time, the print start signal, transmitted from the signal transmission means 64 to the PS roller 20*a* of the driving side, is also output to the time measurement means 61.

Thereafter, the sheet P, to which the toner has been transferred, is subjected to heat and pressure as it passes between the heating roller 31 and the pressurizing roller 32, melting and fastening the unfixed toner on the sheet P thereto. Then, when the sheet P, while being transferred through the transfer route 26 to the sheet ejection tray 25, is detected by the sheet detection sensor 4, a detection signal resulting from the detection by the sheet detection sensor 4 is output to the time measurement means 61. At this time, the time measurement means 61 measures the time T4—a time from when the print start signal is transmitted from the signal transmission means 64 to the PS roller 20*a* of the driving side to when the sheet P is detected by the sheet detection sensor 4.

Then, the sheet P is transferred through the transfer route 26 and ejected to the sheet ejection tray 25 by sheet ejection rollers 26*g*.

In this case, the print start signal from the signal transmission means 64 and the detection signal from the sheet detection sensor 4 are also transmitted to the time storage means 62. The time storage means 62 stores the proper setting time T5—an appropriate time for setting the given end margins, from when the print start signal is transmitted to when the sheet P is detected by the sheet detection sensor 4.

Thus, in the process of forming an image on the sheet P, the transfer distance on the transfer route 26 from the PS rollers 20*a* and 20*b* until the sheet P passes through the sheet detection sensor 4 downstream of the fixing device 3 is constant irrespective of factors such as the sheet transfer speed, the recording sheet qualities (e.g., elasticity, thickness), the conditions of the sheet transfer mechanism 22, the sheet feed method and the individual difference in the printer. As long as the time T3, a time from when the transfer direction print start signal is transmitted from the signal transmission means 64 to when the toner image on the photoconductor drum 21*b* begins to be transferred to the sheet P by the transfer roller 21*d*, is controlled to match with the time period from the edge of the sheet P to a given end margin position thereof, the amounts of the end margins of the sheet P can be determined by monitoring the time T4—a time from when the print start signal is transmitted to when the sheet P is detected by the sheet detection sensor 4. That is, the given end margins are set on the sheet P by correcting the timing for transmitting the print start signal from the signal transmission means 64 such that the time T4 to be monitored is equal to the time T5 that provides the given amounts of end margins. This correction of the timing for transmitting the print start signal is not required every time an image is formed and performed after images are formed on a given number of the sheets p.

This eliminates the need for a difficult operator setting or a setting using a special recording sheet, automatically correcting the end margins of the sheet P and allowing proper setting of the end margins thereof irrespective of factors such as the sheet transfer speed, the sheet qualities (e.g., elasticity, thickness), the conditions of the sheet transfer mechanism 22, the sheet feed method and the individual difference in the printer. Moreover, it is possible to secure the proper end margins even in the presence of secular changes in the printer 1.

It is to be noted that while in the present embodiment, the time T5—an appropriate time for setting the given end margins—is set by the print start signal from the signal transmission means 64 and the detection signal from the sheet detection sensor 4 transmitted to the time storage means 62, it is possible to set more accurate end margins by measuring the time T5, a time for optimizing the end margins, several times and setting the mean value as the time T5.

On the other hand, while in the present embodiment, the setting of the end margins of the sheet P, i.e., the correction of the timing for transmitting a print start signal is performed after images are formed on a given number of the sheets P, the timing for transmitting the print start signal may be corrected at an arbitrary timing such as when the sheets are loaded into the sheet feed tray, and it is possible to secure sufficient amounts of end margins. The timing for transmitting the print start signal may also be corrected if so specified by the user.

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. An image forming apparatus, comprising:

sheet detection means disposed at a predetermined position between an image forming unit and a sheet ejection unit to detect passage of a recording sheet;

time measurement means that measures a time from when a print start signal is transmitted during an end margin adjustment to when the recording sheet is detected by the sheet detection means;

time storage means that stores a proper setting time considered as an appropriate time from when the print start signal is transmitted to when the recording sheet is detected by the sheet detection means to set predetermined end margins; and control means that controls a signal transmission timing of the print start signal, such that an actual measured time measured by the time measurement means for a succeeding recording sheet matches the proper setting time stored by the time storage means.

2. The image forming apparatus according to claim 1, wherein the control means controls the signal transmission timing of the print start signal every time after an image is formed on a predetermined number of recording sheets.

3. The image forming apparatus according to claim 1, wherein the control means controls the signal transmission timing of the print start signal at an arbitrary timing.

4. The image forming apparatus according to claim 3, wherein the control means controls the signal transmission timing of the print start signal when the recording sheets are loaded into a sheet feed tray of the image forming apparatus.

5. The image forming apparatus according to claim 1, wherein the signal transmission timing of the print start signal adjustable by a user.

* * * * *